US007017450B2

(12) United States Patent
Bangert

(10) Patent No.: US 7,017,450 B2
(45) Date of Patent: Mar. 28, 2006

(54) TONG JAW AND A METHOD FOR CONSTRUCTING THE TONG JAW

(76) Inventor: Daniel S. Bangert, 156 Beau Coteau Pkwy., Broussard, LA (US) 70518

( * ) Notice: Subject to any disclaimer, the term of this patent is extended or adjusted under 35 U.S.C. 154(b) by 0 days.

(21) Appl. No.: 10/638,783

(22) Filed: Aug. 11, 2003

(65) Prior Publication Data

US 2005/0034566 A1 Feb. 17, 2005

(51) Int. Cl.
*B25B 13/50* (2006.01)

(52) U.S. Cl. ..... 81/57.33; 81/57.15; 81/57.2; 81/57.18; 166/77.51; 166/85.1

(58) Field of Classification Search ..... 81/57.33, 81/57.34, 57.15, 57.16, 57.2, 57.21, 57.18; 166/77.51, 85.1

See application file for complete search history.

(56) References Cited

U.S. PATENT DOCUMENTS

| | | | | |
|---|---|---|---|---|
| 4,576,067 | A | 3/1986 | Buck | |
| 5,060,542 | A * | 10/1991 | Hauk | 81/57.34 |
| 5,653,297 | A * | 8/1997 | Whisenhunt | 81/57.33 |
| 5,671,961 | A | 9/1997 | Buck | |
| 5,702,139 | A | 12/1997 | Buck | |
| 5,819,604 | A | 10/1998 | Buck | |
| 6,070,500 | A * | 6/2000 | Dlask et al. | 81/57.33 |
| 2002/0108748 | A1 | 8/2002 | Keyes | |

FOREIGN PATENT DOCUMENTS

WO WO 03/093630 A1 11/2003

* cited by examiner

*Primary Examiner*—Debra S Meislin
(74) *Attorney, Agent, or Firm*—Jones, Walker, Waechter, Poitevent, Carrere, & Denegre, L.L.P.

(57) ABSTRACT

A method for constructing a power tong jaw, including the steps of: (1) providing a substantially flat upper plate and a substantially flat lower plate; (2) providing at least two separately formed substantially elongated column members, at least one of the column members having a die insert groove formed therein; and (3) connecting the upper plate to the lower plate using the column members.

30 Claims, 7 Drawing Sheets

TONG JAW AND A METHOD FOR CONSTRUCTING THE TONG JAW

CROSS-REFERENCE TO RELATED APPLICATION

None.

STATEMENT REGARDING FEDERALLY SPONSORED RESEARCH OR DEVELOPMENT

None.

REFERENCE TO A SEQUENCE LISTING, A TABLE, OR A COMPUTER PROGRAM LISTING APPENDIX SUBMITTED ON COMPACT DISC

None.

BACKGROUND OF THE INVENTION

A. Field of Invention

The present invention relates to pipe tongs or power tongs used in the oil and gas industry to make-up and break-out sections of drill pipe and other tubular members having threaded connections. More particularly, the present invention relates to a jaw for use in such tongs and a method for constructing the jaw.

B. Description of Related Art

Power tongs are often employed in the oil and gas industry to break-out or make-up threaded connections on tubular members (such as drill pipe, tubing, or casing). It is generally required that one tong grip and rotate one section of a tubular string and a second tong grip and hold stationary the other section of the tubular string. The first tong rotating the first tubular member is typically referred to as the power tong, while the second tong holding the second tubular member stationary is typically referred to as the back-up tong. Examples of conventional power tongs can be seen in references such as U.S. Pat. Nos. 5,671,961, 5,702,139, and 5,819,604 to Buck, which are incorporated herein by reference.

Power tongs ordinarily have two or more jaws which are actuated to grip and release the tubular member. The actual contact with the tubular is typically accomplished through the use of die inserts which are removably positioned in the power tong jaws. Die inserts are commonly held in place through a dovetail key arrangement or other groove and spline configurations as seen in U.S. Pat. No. 4,576,067 to Buck, which is incorporated herein by reference, and the patents cited therein.

Power tong jaws are commonly machined from solid pieces of metal bar stock, or semi-finished casting or from ring forgings which are rolled to near final dimensions and then machined to final dimensions. An example of jaws 1 constructed in this manner is seen in FIG. 1. It can be seen that the jaw 1 includes a jaw body 4 with dovetail slots 3 formed therein. The rear portion of the jaw body 4 includes a jaw roller 5 secured to the jaw body 4 by a roller pin 6. A number of machine hours on lathes, mills, and saws are required to construct these jaws 1 from the preliminary material. A portion of these hours are spent forming the complex dovetail slot 3 in the jaw 1, which dovetail slot 3 receives the die insert 2. The process of forming jaws from solid material in this manner is costly and time consuming.

Jaws are often formed from multiple pieces for applications where the weight of a completely solid jaw might be excessive. An example of such jaws 106 is seen in FIG. 2. Lower and upper plates 100 and 102 are cut, e.g., using a laser, waterjet, or torch. Afterward, the plates 100 and 102 must be machined or milled before they are connected to a jaw mid-section 101 using bolts 105. Like the solid jaws 1 discussed above, the jaw mid-section 101 is cut from metal bar stock or ring forging and machined. Although the jaw mid-section 101 is smaller in diameter than the solid jaw 1 (and, therefore, involves less material), like the solid jaw 1, the jaw mid-section 101 contains dovetail slots 104 for receiving die inserts 103. As noted above, substantial machine work is required to form these dovetail slots 104. Thus, the process of constructing jaws in this manner is less expensive than constructing jaws out of solid material, but this manner of constructing jaws is still costly—primarily because of the machine work that must be done on the jaw mid-section 101, especially the complex machine work required to form the dovetail slots 104. What is needed in the art is a power tong jaw design which may be manufactured less expensively, from less preliminary material, and requires less machine work.

BRIEF SUMMARY OF THE INVENTION

The present invention provides a jaw for use in power tongs and a method for constructing the jaw.

BRIEF DESCRIPTION OF THE SEVERAL VIEWS OF THE DRAWINGS

FIG. 1(*a*) shows a right jaw, and FIG. 1(*b*) shows a left jaw.

DETAILED DESCRIPTION OF THE INVENTION

The following detailed description refers to the accompanying figures.

The term "power tong" as used herein refers to both power tongs for rotating tubular members and back-up power tongs for holding tubular members stationary against rotation.

Figure 5:
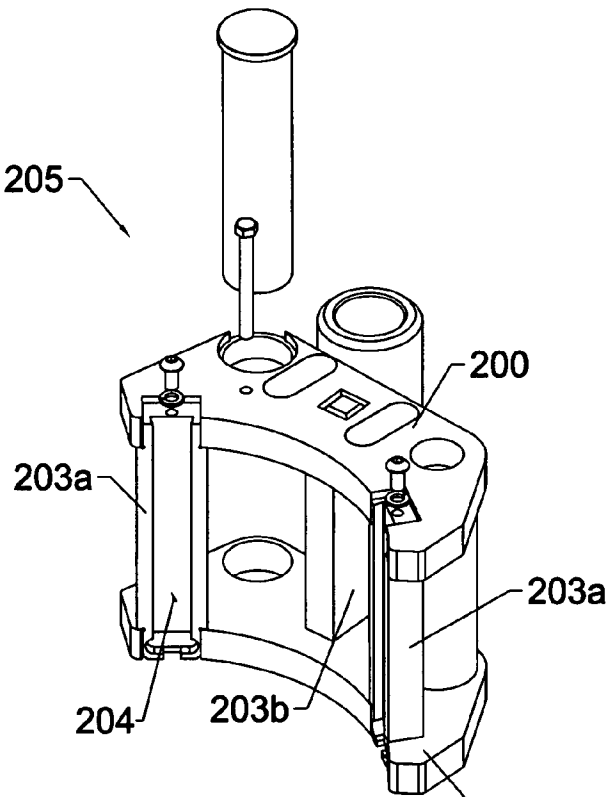
FIG. 5 is an assembled view of a power tong jaw constructed using the method of the present invention.
Figure 3:
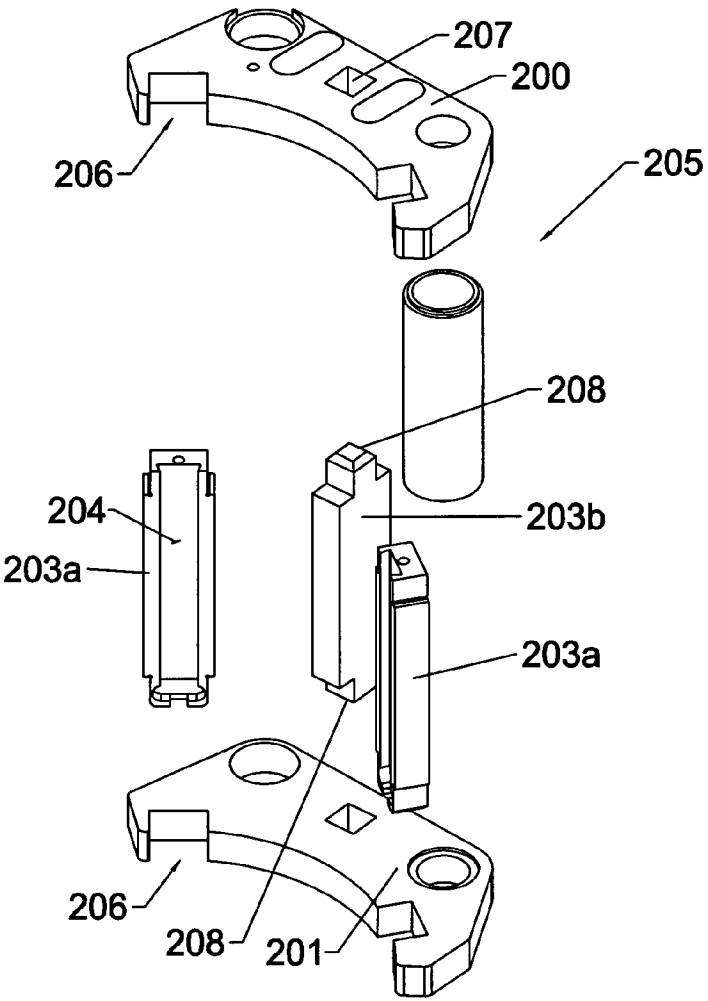
FIG. 3 is an exploded view of a power tong jaw constructed using the method of the present invention.
Figure 4:
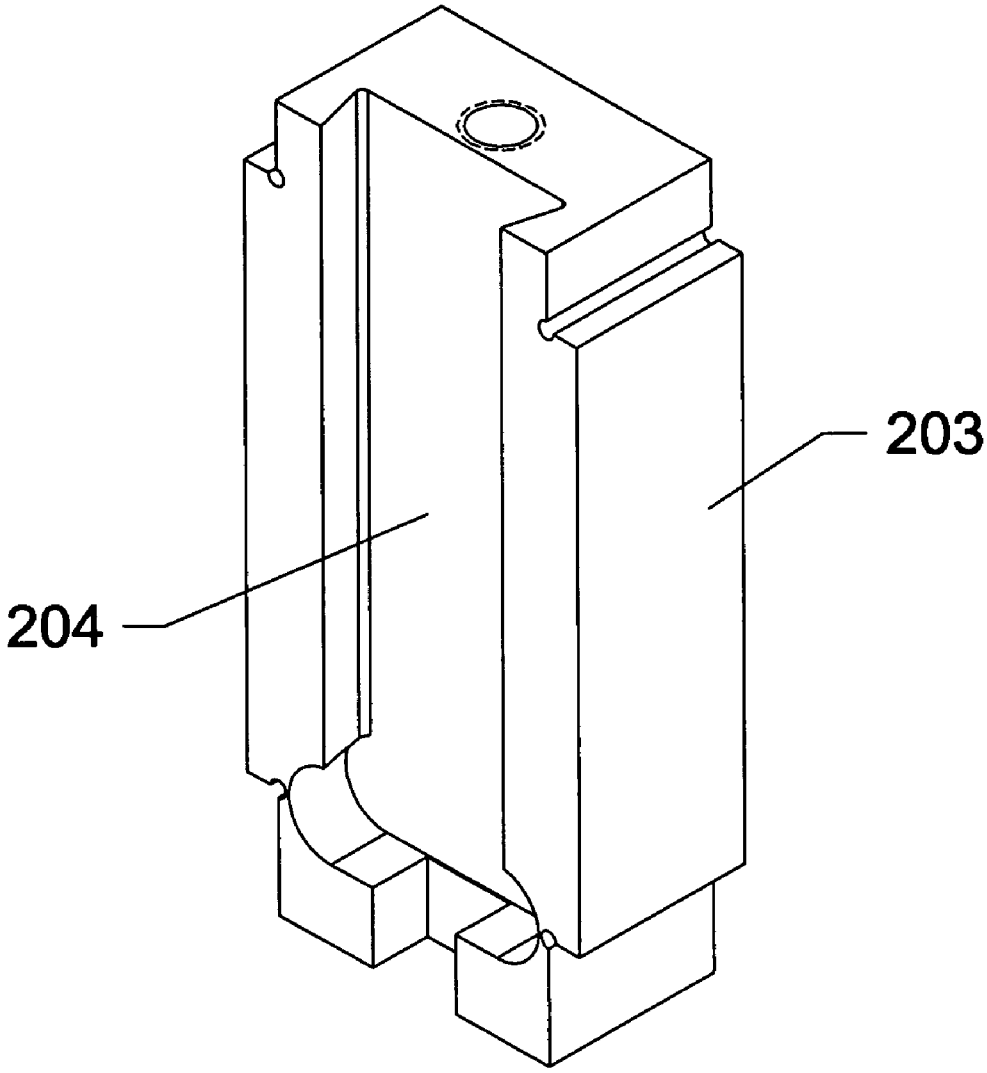
FIG. 4 is a close-up view of a column member having a die insert groove formed therein.

In a preferred embodiment, the invention provides a pivoting power tong jaw as seen in FIGS. 3 and 5. The jaw 205 comprises an upper plate 200, a lower plate 201, and three column members 203. The upper plate 200 and lower plate 201 are arranged horizontally, the former above the latter. The upper plate 200 and the lower plate 201 each contain two column member slots 206 and one column member opening 207. In a preferred embodiment, the upper and lower plates will be formed by a high speed, precision cutting process. Examples of high speed precision cutting processes would include laser cutting or water jet cutting, shear or punch press types of heavy metal fabrication techniques, and may include plasma torch cutting. Plasma torch cutting and flame torch cutting would generally not be considered precision cutting processes, and conventional milling would not be considered high speed, although these methods could be used in less preferred embodiments for producing the plates, as could casting processes. As illustrated in FIGS. 3 and 5, each of the column members 203 is positioned vertically. Two of the column members 203*a* have die insert grooves 204 formed in them for receiving dies. (A close-up view of a column member 203*a* is depicted in FIG. 4, which clearly shows the die insert groove 204.) As seen in FIGS. 3 and 5, the two column members 203*a* having the die insert grooves 204 are positioned between the upper plate 200 and lower plate 201 such that each end of each of these column members 203*a* fits into a corresponding column member slot 206. The column members 203 are welded into place, or secured by another common method (e.g., using bolts or screws). The third column member 203*b* is also positioned between the upper plate 200 and the lower plate 201. This column member 203*b* does not have a die insert groove 204 and has points 208 at each end which extend through the column member openings 207 in the upper plate 200 and lower plate 201, thereby stabilizing the column member 203*b*.

Figure 1:
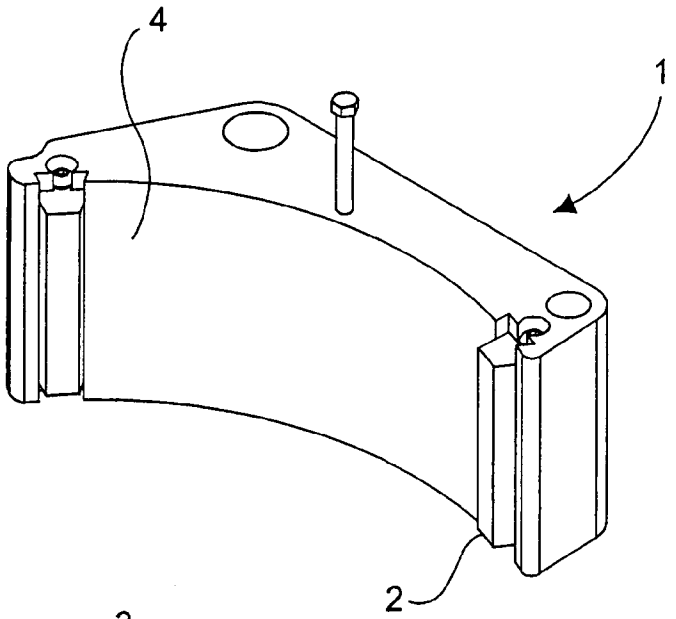
FIG. 1 is an exploded view of a prior art power tong jaw constructed from solid metal.
Figure 1:
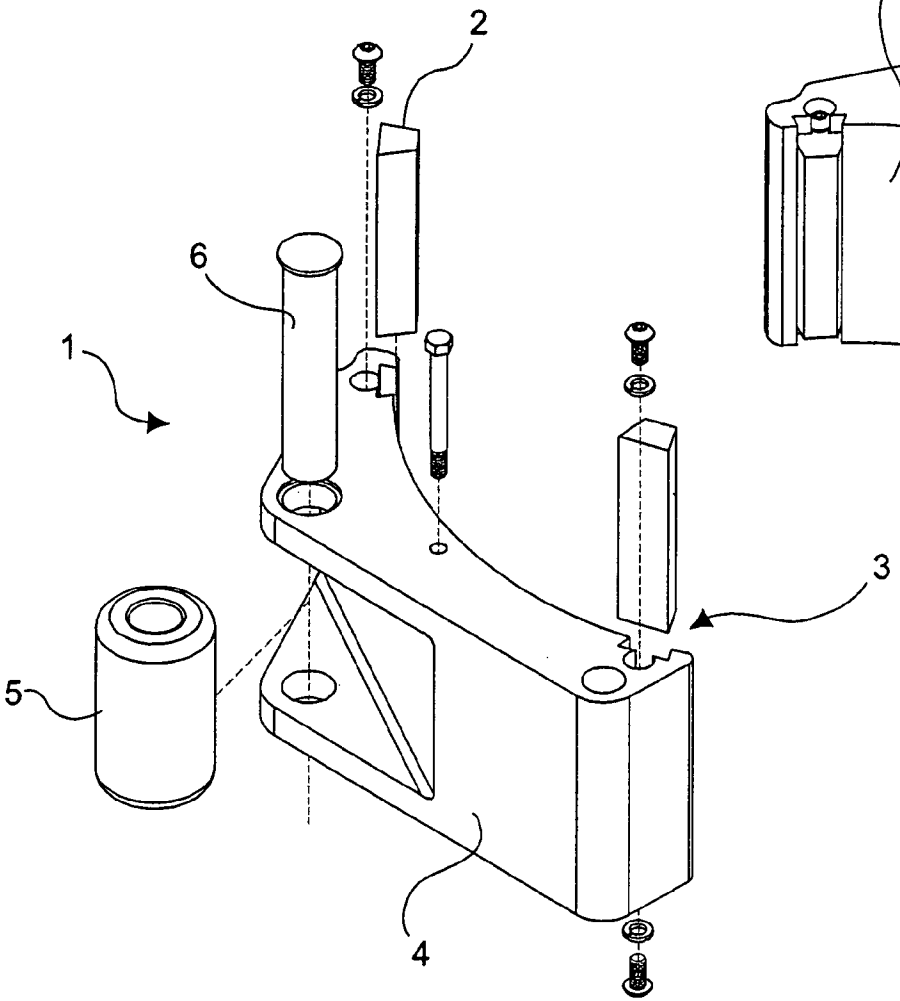
Figure 2:
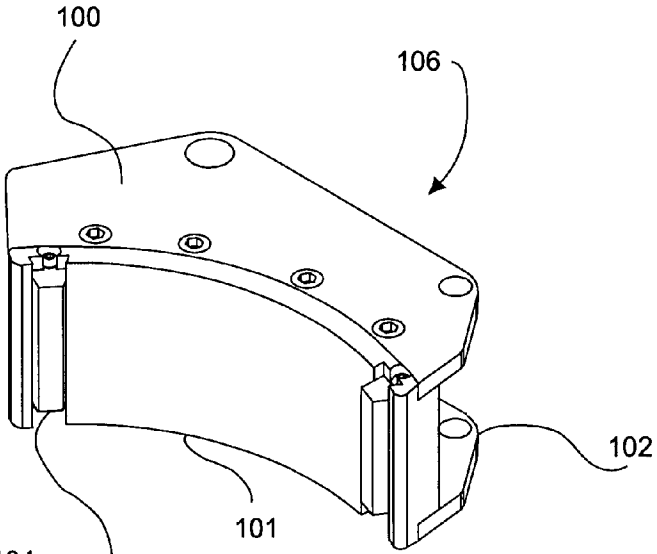
FIG. 2 is an exploded view of a prior art power tong jaw constructed from multiple pieces FIG. 2(*a*) shows a right jaw, and FIG. 2(*b*) shows a left jaw.
Figure 2:
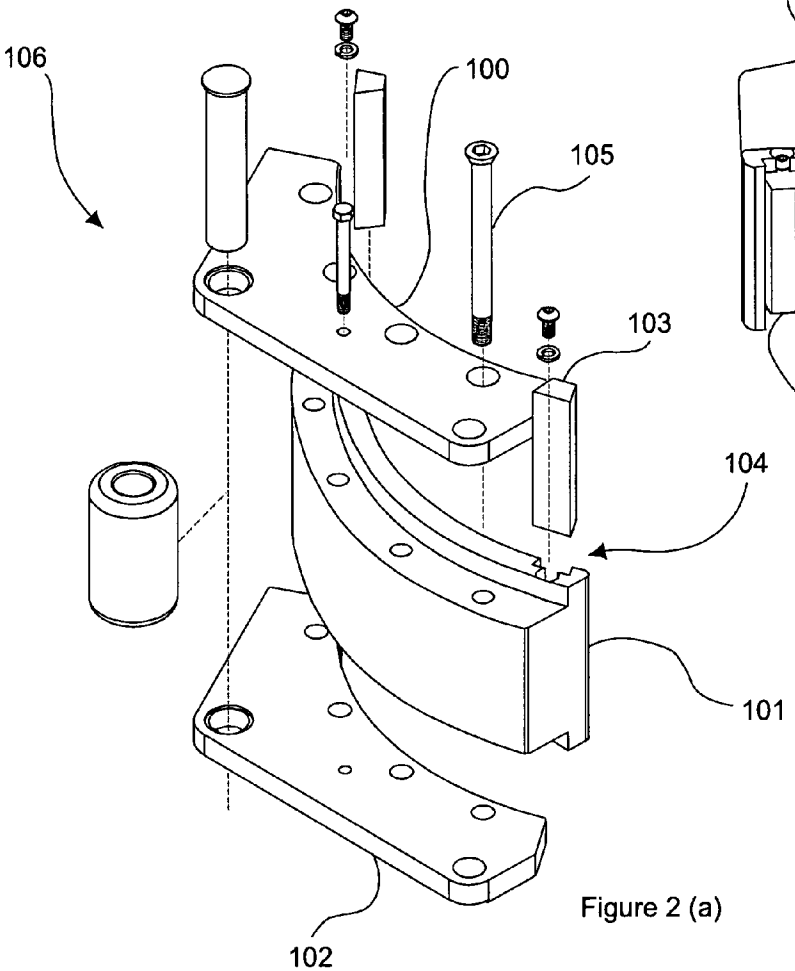

As seen in FIGS. 3 and 5, the jaw insert 101 (depicted in FIG. 2) is not present in this embodiment of the present invention. Thus, this design greatly reduces the amount of material and machining required to produce the jaw. Additionally, the column members can be formed by a more economical method than machining, such as investment casting. Thus, a large number of identical column members could be produced for use in constructing the tong jaws of the present invention. Because the column members contain the complex detail required to retain the dovetail die inserts, the casting further reduces the amount of machining required to produce each tong jaw. Moreover, the same column members may be used on a variety of different jaw sizes (i.e., jaws designed to grip different diameter tubulars). To produce different sized jaws, it is only necessary to modify the top and bottom plates. Thus, one benefit of this design is that a jaw for an usual diameter tubular may be manufactured very quickly by cutting the correct size top and bottom plates and assembling them with pre-manufactured column members, which would be the same size regardless of the top and bottom plate dimensions. This method can reduce the time necessary to produce a non-standard sized jaw from days to hours. This method is also far more economical than prior art methods, allowing jaws of the present invention to be produced at approximately 77% of the material and production cost of prior art jaws.

Figure 6:
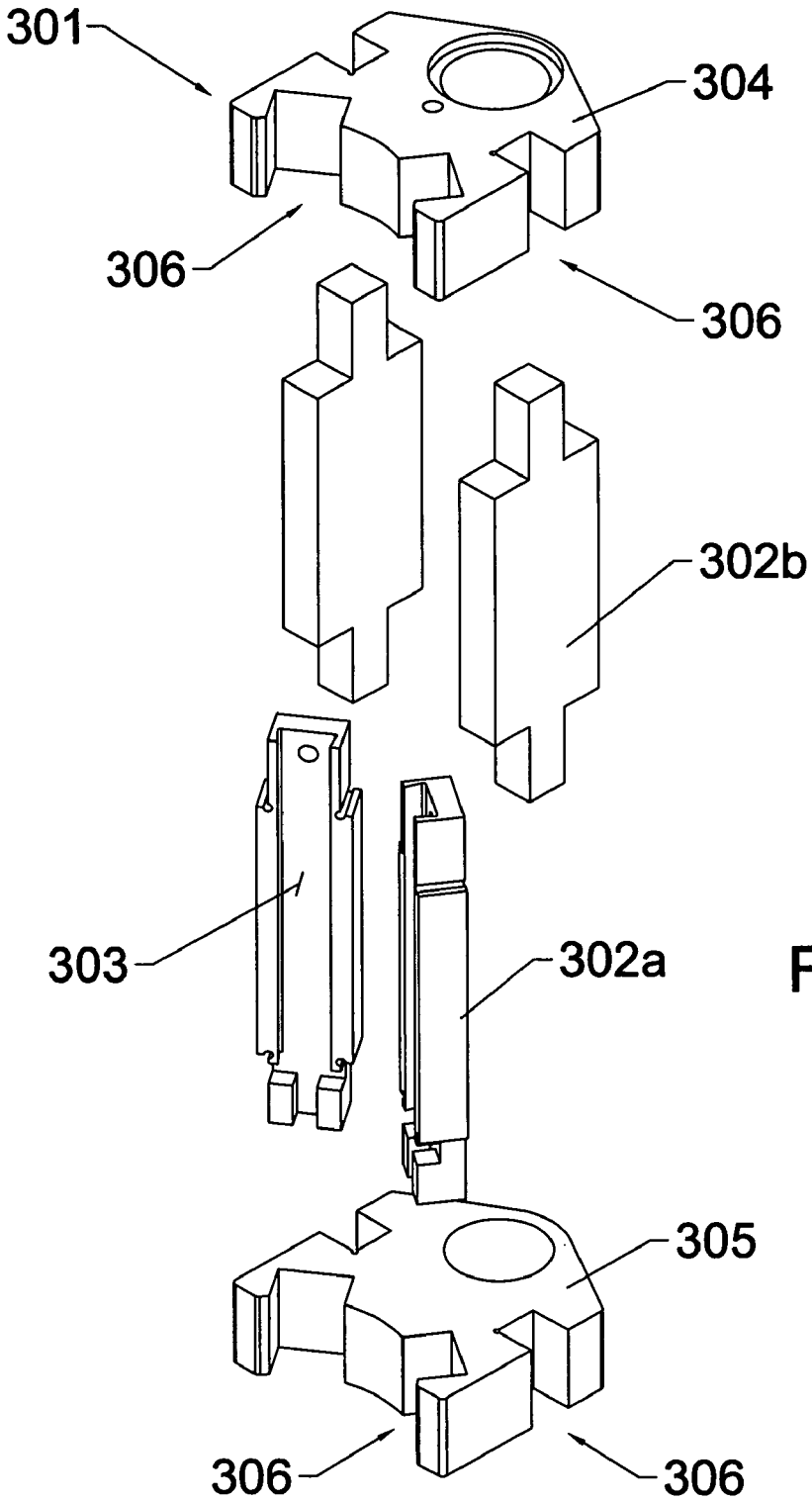
FIG. 6 is an exploded view of a power tong jaw member constructed using the method of the present invention.
Figure 7:
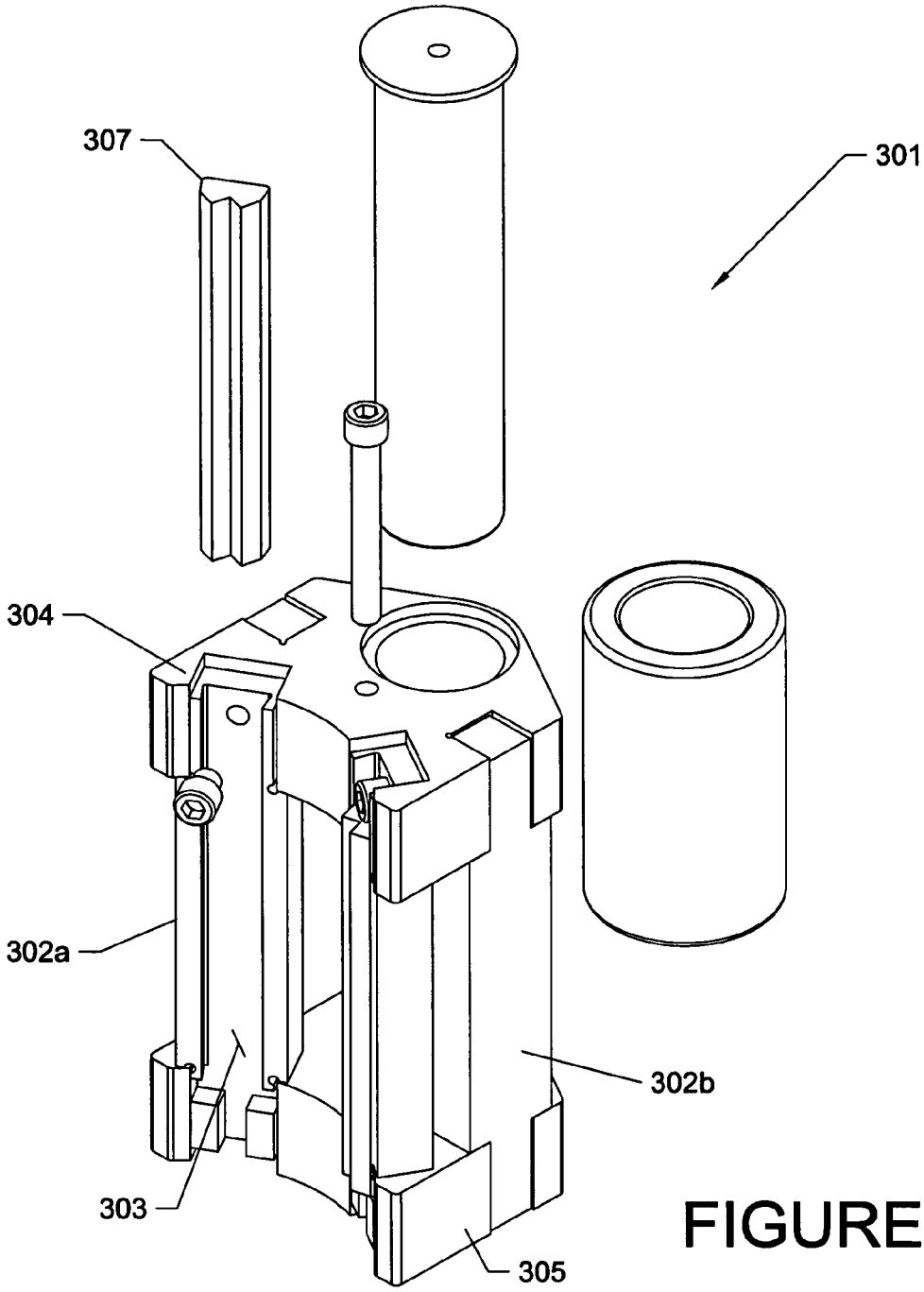
FIG. 7 is an assembled view of a power tong jaw member constructed using the method of the present invention.

In another embodiment, the invention provides a power tong jaw member as seen in FIGS. 6 and 7. The jaw member 301 comprises an upper plate 304, a lower plate 305, and four column members 302. The upper plate 304 and lower plate 305 are arranged horizontally, the former above the latter. The upper plate 304 and lower plate 305 contain column member slots 306. The column members 302 are connected to the upper plate 304 and lower plate 305 at the column member slots 306. Two of the column members 302*a* have die insert grooves 303 for retaining die inserts 307. As illustrated in FIG. 7, the column members 302*a* having die insert grooves 303 are positioned such that the die inserts 307 face inwardly in an arcuate orientation corresponding to the curvature of the particular diameter tubular being gripped, thereby allowing both of the die inserts 307 to come into contact with the surface of a tubular when the power tong jaw member 301 is in use. The column members 302*b* which do not have die insert grooves 303 are positioned parallel to each other on opposite sides of the upper plate 304 and lower plate 305.

The power tong jaw member seen in FIGS. 6 and 7 could be used in a sliding jaw adaptor for pivoting jaw power tongs as seen in U.S. patent application Ser. No. 10/139,053, which is incorporated by reference herein. The jaw members of the present invention could replace the sliding solid jaw members seen therein.

Figure 8:
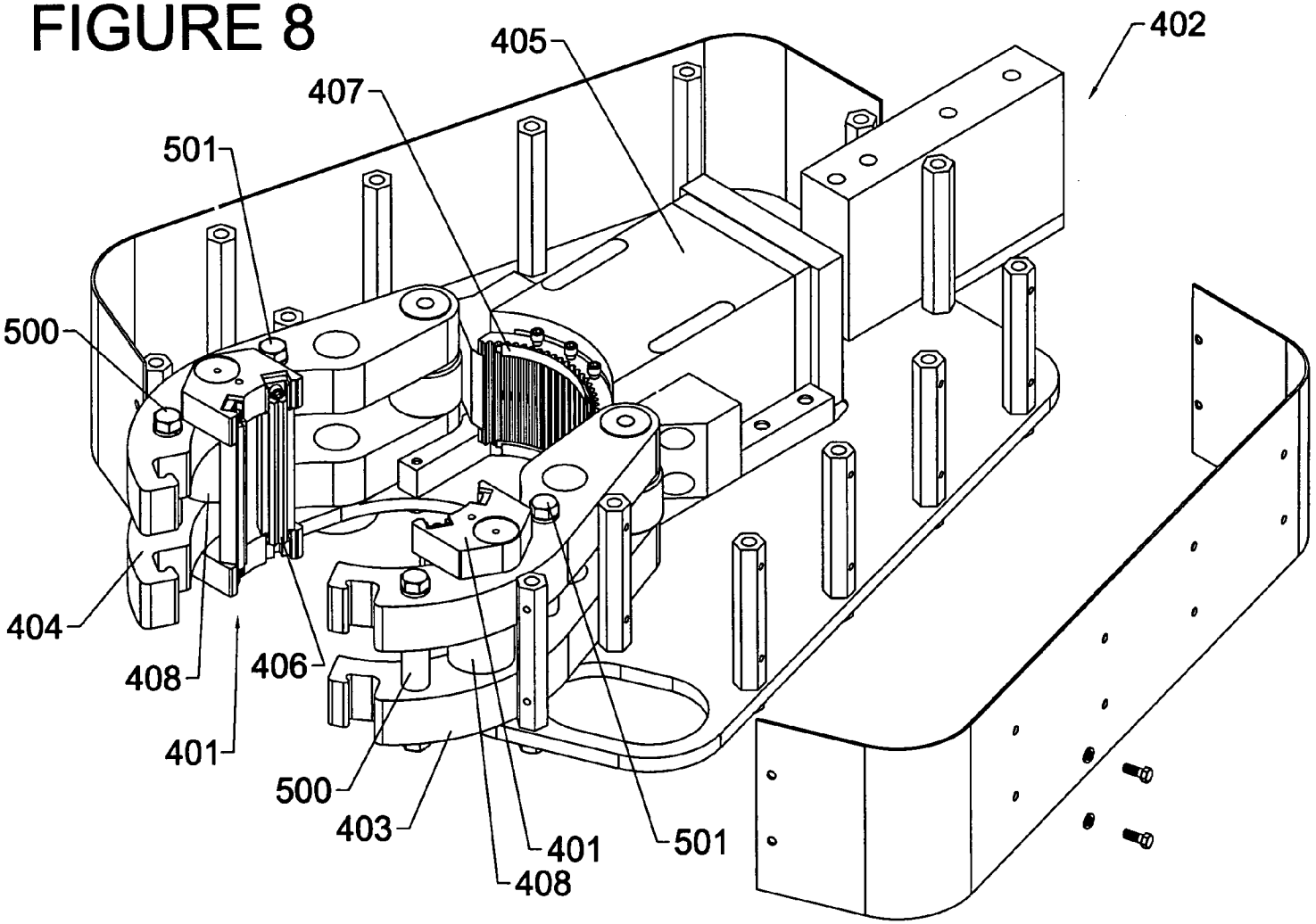
FIG. 8 is a perspective view of a back-up power tong incorporating a jaw member of the present invention.

This embodiment of the present invention could also be used to replace the solid arcuate jaw members found in back-up power tongs known in the art, for example, the back-up power tongs shown in U.S. Pat. No. 5,702,139 to Buck, which is incorporated herein by reference in its entirety. A back-up power tong design incorporating power tong jaw members according to the present invention is illustrated in FIG. 8. FIG. 8 shows a back-up power tong 402 a having power tong jaw member 401 mounted on an outside jaw assembly 404 and an inside jaw assembly 403. As shown in FIG. 8, this jaw member is similar to that seen in FIGS. 6 and 7, however, there are no column members on the side of this embodiment of the jaw member. As discussed in U.S. Pat. No. 5,702,139 to Buck, when actuated, the outside jaw assembly 404 and inside jaw assembly 403 of the back-up power tong shown in FIG. 8 lock together around a tubular (not shown). A cylinder assembly 405 having an arcuate jaw member 407 is extended toward the jaw members 401 so that the arcuate jaw member 407 engages the tubular. The contact between the arcuate jaw member 407 and the tubular brings the tubular into contact with the die inserts 406 on the jaw members 401, which, in cooperation with the arcuate jaw member 407, grip the tubular. A polyurethane cylindrical spring 408 is used to hold the jaw member 407 in the proper position for the initial bite, but allows the jaw member 407 to move to accommodate undersized tubulars or to compensate when subjected to high torques. While only one spring 408 is shown in contact with each of the jaw members 401 in FIG. 8, it will be understood a second spring 408 is located on the other side of jaw 401, but is hidden from view. The springs 408 are composed of relatively rigid elastic material and are secured by being positioned between the jaw member 401 and bolts 500 (or bolts 501 for the spring hidden from view). The springs 408 could be secured by other means known in the art, e.g., it could be secured by pins running through the jaw assembly and the spring. While the pivoting jaw embodiment of the present invention offers the greatest cost savings, the sliding jaw adapter embodiment and the back-up power tong embodiment also offer significant savings over earlier power tong jaw designs known in the art.

While many parts of the present invention have been described in terms of specific embodiments, it is anticipated that still further alterations and modifications thereof will no doubt become apparent to those skilled in the art. For example, other designs besides a dovetail slot might be used to retain die inserts, or the number of column members having die insert grooves could be altered. Other embodiments are possible and modifications may be made to the embodiments without departing from the spirit and scope of the invention. The preceding detailed description is not meant to limit the invention. Rather, the scope of the invention is defined by the appended claims. It is therefore intended that the following claims be interpreted as covering all such alterations and modifications as fall within the true spirit and scope of the invention.

What is claimed is:

1. A power tong jaw comprising:

a. an upper plate and a lower plate; and b. at least three column members positioned between said upper plate and said lower plate, at least two of said column members having die insert grooves formed therein.

2. The power tong jaw of claim 1, wherein said column member not having one of said die insert grooves therein comprises a tip at each of said column member's ends.

3. The power tong jaw of claim 2, wherein said upper plate and said lower plate each comprise two column member slots and one column member opening.

4. The power tong jaw of claim 3, wherein said column member not having one of said die insert grooves therein is positioned between said upper plate and said lower plate such that said tips of said column member extend into said column member openings.

5. The power tong jaw of claim 4, wherein each of said column members having one of said die insert grooves therein is connected to said upper plate and said lower plate at said column member slots.

6. The power tong jaw of claim 1, wherein said power tong jaw comprises four said column members, two of said column members having said die insert grooves formed therein.

7. The power tong jaw of claim 6, wherein each of said column members not having one of said die insert grooves therein comprises a tip at each of said column member's ends.

8. The power tong jaw of claim 7, wherein each of said upper plate and said lower plate comprises two column member slots and two column member openings.

9. The power tong jaw of claim 8, wherein said column members not having one of said die insert grooves therein are positioned between said upper plate and said lower plate such that said tips of said column members extend into said column member openings.

10. The power tong jaw of claim 9, wherein said column members are positioned parallel to each other.

11. The power tong jaw of claim 10, wherein each of said column members having one of said die insert grooves therein is connected to said upper plate and said lower plate at said column member slots.

12. The power tong jaw of claim 11, wherein said column members having said die insert grooves therein are positioned to face inwardly in an arcuate orientation.

13. The power tong jaw of claim 12, wherein said power tong jaw is capable of being incorporated into a sliding jaw adaptor for a pivoting jaw power tong.

14. The power tong jaw of claim 1 wherein said tong jaw further comprises a jaw roller.

15. The power tong jaw of claim 14, wherein said jaw roller is positioned between said upper plate and said lower plate.

16. A method for constructing a power tong jaw comprising the steps of:

a. providing a substantially flat upper plate and a substantially flat lower plate;

b. providing at least one substantially elongated column member having a die insert groove formed therein;

c. providing at least one substantially elongated column member not having one of said die insert grooves formed therein; and d. connecting said upper plate to said lower plate with said column members.

17. The method of claim 16, wherein said at least one column member not having one of said die insert grooves therein comprises a tip at each of said column member's ends.

18. The method of claim 17, wherein each of said upper plate and said lower plate comprises two column member slots and a column member opening.

19. The method of claim 18, wherein said column member not having one of said die insert grooves therein is positioned between said upper plate and said lower plate such that said tips of said column member extend into said column member openings.

20. The method of claim 19, wherein each of said column members having one of said die insert grooves therein is connected to said upper plate and said lower plate at said column member slots.

21. The method of claim 16, wherein said step of providing said column members includes manufacturing said column members by a casting process.

22. The method of claim 16, wherein said step of providing said upper and lower plates includes manufacturing said plates by a high speed, precision cutting method.

23. The method of claim 16 further comprising the step of connecting a jaw roller to said tong jaw.

24. The method of claim 23 further comprising the step of positioning said jaw roller between said upper plate and said lower plate.

25. A method for constructing a power tong jaw comprising:

a. providing a substantially flat upper plate and a substantially flat lower plate;

b. providing at least two separately formed substantially elongated column members, at least one of said column members having a die insert groove formed therein; and c. connecting said upper plate to said lower plate using said column members.

26. The method of claim 25 further comprising the step of connecting a jaw roller to said tong jaw.

27. The method of claim 26 further comprising the step of positioning said jaw roller between said upper plate and said lower plate.

28. A power tong jaw comprising:

a. an upper plate and a lower plate; and b. at least two separate means for connecting said upper plate to said lower plate, said at least two means for connecting said upper plate to said lower plate being positioned between said upper plate and said lower plate, at least one of said means for connecting said upper plate to said lower plate comprising means for gripping a tubular member.

29. The power tong jaw of claim 28 wherein said tong jaw further comprises a jaw roller.

30. The power tong jaw of claim 29, wherein said jaw roller is positioned between said upper plate and said lower plate.

* * * * *